US006190762B1

(12) United States Patent
Rödiger et al.

(10) Patent No.: US 6,190,762 B1
(45) Date of Patent: Feb. 20, 2001

(54) COMPOSITE BODY AND METHOD OF PRODUCING THE SAME

(75) Inventors: Klaus Rödiger, Bochum; Klaus Dreyer, Essen; Monika Willert-Porada, Dortmund; Thorsten Gerdes, Castrop-Rauxel, all of (DE)

(73) Assignee: Widia GmbH, Essen (DE)

( * ) Notice: Under 35 U.S.C. 154(b), the term of this patent shall be extended for 0 days.

(21) Appl. No.: 09/101,403

(22) PCT Filed: Dec. 5, 1996

(86) PCT No.: PCT/DE96/02353

§ 371 Date: Jul. 7, 1998

§ 102(e) Date: Jul. 7, 1998

(87) PCT Pub. No.: WO97/26383

PCT Pub. Date: Jul. 24, 1997

(30) Foreign Application Priority Data

Jan. 15, 1996 (DE) ..... 196 01 234

(51) Int. Cl.[7] ..... C04B 35/65

(52) U.S. Cl. ..... 428/325; 428/698; 428/699; 501/87; 501/96; 264/432

(58) Field of Search ..... 428/698, 699, 428/325; 501/87, 96; 264/432

(56) References Cited

U.S. PATENT DOCUMENTS

| | | | |
|---|---|---|---|
| 4,675,206 | | 6/1987 | Ikegaya et al. . |
| 5,051,126 | * | 9/1991 | Yasui et al. . |
| 5,256,368 | | 10/1993 | Oden . |
| 5,451,365 | | 9/1995 | Barsoum . |
| 5,462,901 | * | 10/1995 | Egami et al. . |
| 5,653,775 | * | 8/1997 | Plovnick et al. . |
| 5,693,408 | * | 12/1997 | Van Den Berg et al. . |

FOREIGN PATENT DOCUMENTS

| | | | |
|---|---|---|---|
| 720357 | | 4/1942 | (DE) . |
| 27 16 413 | | 10/1978 | (DE) . |
| 35 15 919 A1 | | 11/1986 | (DE) . |
| 35 44 975 | | 4/1987 | (DE) . |
| 40 00 937 A1 | | 7/1990 | (DE) . |
| 41 10 006 A1 | | 10/1992 | (DE) . |
| 42 16 802 A1 | | 11/1993 | (DE) . |
| 42 39 234 A1 | | 6/1994 | (DE) . |
| 44 17 799 A1 | | 11/1994 | (DE) . |
| 43 40 652 A1 | | 6/1995 | (DE) . |
| 100 95 27 | * | 3/1997 | (DE) . |
| 197 22 728 | * | 6/1998 | (DE) . |
| 0 675 212 A1 | | 10/1995 | (EP) . |
| 37695 | | 1/1914 | (FR) . |
| 2 140 823 | | 12/1984 | (GB) . |
| 2 274 467 | | 7/1994 | (GB) . |
| WO 91/19584 | | 12/1991 | (WO) . |

OTHER PUBLICATIONS

Metall Wissenschaft + Technik, Hartmetalle det neuen Generation, 47, Jahrgang, Heft, 10 Oktober 1993, pp. 908–914.
Patent Abstracts of Japan, M–691, Apr. 28, 1988, vol. 12, No.
Patent Abstracts of Japan, M–776, Dec. 16, 1988, vol. 12/No. 484.

* cited by examiner

*Primary Examiner*—Deborah Jones
*Assistant Examiner*—Jason Savage
(74) *Attorney, Agent, or Firm*—Herbert Dubno

(57) ABSTRACT

A cermet or hard metal body is formed from elemental metal, carbon and a nitrogen source such as a metal nitride or an organic nitrogen source by microwave sintering such that chemical reaction occurs with the formation of carbides and/or carbonitrides. The elemental metal, carbon and nitrogen source are mixed together and prepressed to form the green body which is subjected to the microwave radiation in reaction sintering.

29 Claims, No Drawings

COMPOSITE BODY AND METHOD OF PRODUCING THE SAME

CROSS REFERENCE TO RELATED APPLICATIONS

This application is a national stage of PCT/DE96/02353 filed Dec. 5, 1996 and based upon German national application 196 012 34.1 of Jan. 15, 1996 under the International Convention.

The present invention relates to an oxide-free composite body with a binder metal phase and at least one hard phase substantially consisting of:

a cermet composition with a binder metal phase of 2 to 30 mass % (weight %), balance at least one carbonitride phase or a hard metal with at least one hard material phase of 65 to 99 mass %, balance binder metal phase.

The invention also relates to a process for producing the composite body.

INVENTION

Composite materials of the aforedescribed type are described in DE 43 40 652 A1. Such composite bodies are especially used as cutting plates for chip removal machining, but also as high temperature materials. According to the conventional technology, these bodies are prepressed from previously prepared hard material powders and metals, with addition of a plastifying medium, after mixing, to shaped bodies. The shaped bodies are then sintered in an electrically heated furnace which, for example, is equipped with graphite heating elements, whereby the heating of the samples is effected indirectly by means of radiation emitted from the heating elements or by convection or thermal conductivity. Usually a pretreatment involves intensive milling of the hard material powder, the mixing and milling of numerous additives and the binder metal for optimum shaping in combination with a pressure sintering, or a sintering hot isostatic pressing or hot isostatic pressing. The fine grained character of the starting powders used according to the state of the art are desirable also for additives which serve as grain-growth blockers. These additional substances are present, after the sintering, as brittle phases and reduce, correspondingly, the ductility and the corrosion resistance of the composite body.

To improve the bend-to-break strength and the hardness of such composite bodies, it has been proposed in DE 43 40 652 to carry out a sintering of the prepressed shaped body in a microwave field. In this case, with higher contents of the binder metal the effectiveness of the heating by microwave of the preformed pressed body is increased. The shaped body is directly heated by the microwave sintering.

OBJECT OF THE INVENTION

Based upon this state of the art, it is an object of the present invention to obtain hard metals and cermets with fine grain structures, whose ductility is improved with simultaneously greater hardness and strength.

SUMMARY OF THE INVENTION

This object is attained, in an oxide-free composite body of the type mentioned at the outset, in which the metals, the carbon as well as optionally other metals and metal carbides and other nitrides required for the formation of the hard phase, namely, the carbonitride phase or phases (with cermets) or the hard material phase or hard phase (in the case of hard metal) are exclusively each in a powder form, i.e. as a solid, compacted to a green body and then subjected to a microwave field in a pressure-free reaction sintering, whereby the hard phases which are formed with the remaining further materials which do not participate in the hard phase reaction, for a liquid phase. The thus obtained shaped bodies have in relation to the particle size of the educt powder used, a substantially reduced grain size in the final product. The lattice structure is fine grained and uniform; the composite body has an unusually high ductility while simultaneously maintaining its high hardness and strength. As a result of the formation of the liquid phase, a complete compaction of the composite body is achieved on sintering. Simultaneously in the production of the composite body according to the invention, hitherto required processing steps are eliminated, like the carburization of the starting materials and additional milling and processing steps. The hard phase is obtained in situ from the starting materials required for the carburization reaction during the same heat treatment which also gives rise to sintering of the shaped body. The liberated reaction heat from the reaction forming the hard phase can be used to apply the necessary activation energy for the sintering. The complete compaction of the shaped body is obtained without additional operations like the application of pressure, or encapsulation which hitherto have been necessary according to the state of the art.

Earlier attempts to synthesize materials like TiC by mixing the starting materials, namely, titanium and carbon utilizing the effect of heat in a furnace, fail because of the development of gaseous byproducts from carbothermic reductions, whereby the resulting gas byproducts, like CO or $CO_2$ can give rise to undesired inclusions and thus porous shaped bodies. Limited help can be obtained only by the application of a high external pressure which significantly increases the manufacturing costs. It has also been proposed previously to introduce metal powder like titanium and chromium or silicon, with inert auxiliary materials or organic compounds and to treat the resulting gas pyrolytically. In all of these cases the presence of a gas phase impedes or prohibits a sufficiently good compaction upon sintering.

Surprisingly the directed use of material specific characteristics by means of a microwave heating, can give rise to control of the reaction in a solid pressed body comprised of various metal powder type and of nonmetallic powders whereby apart from one or more hard phases, a liquid phase also arises which accelerates the sintering. The use of microwave radiation allows, by contrast with the conventional heating or ignition processes of the state of the art, the simultaneous carburization or carbonitriding and the sintering. The sinter charge can, by the microwave heating, be brought to reaction even independently of heat transfer within the charge by microwave dissipation in volumes of the sinter charge.

Furthermore, by means of a microwave heating a rapid after-heating is possible without loss of the reaction heat to the surroundings. Rather, the reaction heat is used in the binding of the starting materials so that the formation reaction of the hard phase takes place in the solid as well as in the liquid state together with the dissolving and reprecipitation of the hard phase from the binder metal in the presence of the microwave field, substantially more rapidly than without the electromagnetic alternating field. The extremely fine grained structure is possible with a rapid compaction in this manner. Thus, especially in the production of a composite body starting from tungsten powder with an average mean particle size of 1 Am, Co powder and carbon black, a WC-Co hard metal can be achieved with grain size of 0.4 to 0.8 μm, i.e., grain sizes which lie below the starting grain size of the tungsten powder. Special characteristics like, for example, the hardness, tendency to corrosion, magnetic, electronic and thermomechanical properties can be combined also by correspondingly selected starting mixtures.

Because of the effect of the microwave field, there is a direct reaction of metals with the carbon for hard phase formation as, for example, the reaction of tungsten with carbon to WC or a corresponding hard phase formation to TiC, ZrC, HfC, VC, NbC, TaC, $Cr_2C_3$ or $MO_2C$. This mentioned reaction is carried out substantially more rapidly and also at lower temperatures than is the case with conventional heating. In the microwave reaction sintering, initially the hard phase is formed which is partly dissolved in the binder metal. For example, the solubility of the hard phase in cobalt (as binder) at the eutectic temperature in mol % is: TaC, HfC:3; TiC:5; ZrC, NbC:6; VC:10; $Cr_2C_3$:12; WC:20; $MC_2C$:30. Thus even with relatively small amounts of solubilized carbide, a crystallization of the hard phase can be expected. The eutectic melt which is formed is rapidly drawn into all capillaries of the dielectrically inhomogeneous body under the effect of the electromagnetic alternating field. As a result, the porous body compacts uniformly in volume as hitherto has only been the case when a high external pressure was used. The hard phase dissolved in the binder metal crystallizes out on hard phase residual grains. Only in this manner can a very fine grained hard phase be obtained with a grain morphology of typical angular grains.

With microwave reaction sintering it is found that above all cermets, which are constituted from the less soluble carbides, provide a reduced grain size of the hard phase with respect to conventional fabrication processes. By the reaction of .the metals contained in the starting mixture with carbon, initially very small hard phase grains whose solubility is very high develop in the microwave field. The liquid phase which is formed is much more quickly distributed in the lattice structure, as a consequence of the capillary forces and the dielectric inhomogeneity of the sintered part, than is the case without the electrical alternating field. Thus the saturation concentration of the carbide in the binder metal will also rapidly be exceeded locally so that sufficient crystallization nuclei are provided of undissolved hard phase on which the solubilized hard phase can crystallize. The result of the microwave reaction sintering is a large number of finer structures than are conventionally generated as a result of sintering, microwave sintering or conventional sintering. Because of the reaction promoting effect of the microwave field, it is also not necessary to provide a low melting eutectic to enable the hard phase formation reaction to be carried out. It suffices that a small amount of the liquid phase is produced from the hard phase and the binder metal.

Furthermore, the distribution of the liquid phase is accelerated to promote compaction by the capillary forces, via the electroponderomotor effect of the electronic alternating field so that application of an outer pressure can be avoided. With use of the microwave reaction sintering technique, the drawback of conventional sintering, that the choice of the furnace atmosphere is limited by the chemical properties of the heating elements can be avoided. The heating of the hard metal or cermet is effected from the outside inwardly and is controlled substantially by the thermal conductivity and the emissivity of the samples. Depending upon the thermal conductivity of the samples the range of variations of the heating and cooling rates can be greatly limited which has necessitated high apparatus and processing requirements in the past to enable satisfactory sintering of, for example, ultrafine grained hard metals.

The composite body according to the invention is characterized in that it contains no grain growth blocker, especially no V and/or Cr. At least 70 volume % of the hard metal composite body can have a mean grain size <0.5 μm, preferably <0.4 μm. At least 70 volume % of a cermet composite body can have a mean grain size <0.4 μm, preferably <0.3 μm.

The cermet or the hard metal can have a hard phase based on Ti, Zr, Hf, Nb, Ta, Mo, and/or W, and a binder metal phase of Co, Ni, and/or Fe.

The hard metal can have hexagonal WC as a first phase and cubic carbide of mixed crystals of W, Ti, Ta and/or Nb as a second phase and a binder metal phase of Co, Ni, Fe or mixtures thereof.

The hard metal can be comprised of the hexagonal mixed carbide WC with MoC and/or cubic mixed carbides of the elements Ti, Zr, Hf, V, Nb, Ta, Cr, Mo, and/or W, with a binder metal phase of Co, Fe, and/or Ni.

The binder metal phase can have up to 15 mass % Mo, W and/or Ti with reference to the total mass of the binder metal phase.

The binder metal phase can have up to 5 mass %, preferably up to 3 mass % Mm and/or Al, with reference to the total mass of the binder metal phase.

The binder metal phase can be comprised of an Al-Ni alloy with an Ni-Al ratio of 90:10 to 70:30.

The binder metal phase can contain up to one mass % boron with reference to the total mass of the binder metal phase.

The binder metal phase can be comprised of $Ni_3Al$, $TiSi_2$, $Ti_2Si_3$, $Ti_3Al$, $Ti_5Si_3$, TiAl, $Ni_2TiAl$, $TiSi_2$, NiSi, $MoSi_2$ or mixtures thereof. 0 to 16 mass % of Co, Ni, Fe and/or rare-earth metals can be added.

The binder metal phase can include Ni and Cr and Mo, Mn, Al, Si and Cu can be added in amounts of 0.01 to 5 mass %.

The composite body can have one or more layers applied preferably in a microwave field by means of PVD, CVD and/or PCVD.

Preferably, the composite body contains no grain growth blockers, especially no vanadium and/or chromium. By contrast with the state of the art, the hard metal composite body of the invention is characterized in that it has at least 70 volume percent of a mean grain size of a maximum of 0.5 % μm, preferably a maximum of 0.4 μm. According to the invention, cermet composite bodies consist of at least 70 volume percent with a mean grain size of <0.4 μm, preferably <0.3 μm. The quantitative and qualitative compositions of the composite body according to the invention is given, in accordance with further features of the invention, from the claims 5 through 16.

The invention comprises, further, a process for producing an oxide-free composite body of the type described at the outset, in which the metals, the carbon and optionally other metals and metal carbides and metal nitrides and/or solid nitrogen compounds as suppliers of the carbon and/or nitrogen, required for formation of the hard phase, are exclusively present respectively in powder form and the composite is prepreseed to a shaped body and then, under a pressure of $<5\times10^5$ Pa, preferably without pressure, is subjected to a reaction sintering at least briefly in a microwave field with an energy density of 0.01 to 10 $W/cm^3$. The composite body produced by the microwave sintering has an extremely fine grained structure that, as a result of the microwave reaction sintering technique used, is finer than the starting grain size. The metal carbides serving as a basis of the hard metal body produced is especially generated from metals and carbon black or graphite which are present in the starting mixture in powder form.

For cermets, the same applies with the feature that, as nitrogen sources, metal nitrides or solid nitrogen compounds are present in pulverized form in the starting mixture.

The microwave reaction sintering of the respective powder starting material to carbides or carbonitrides runs relatively quickly and with heat development (exothermically). After the carbide formation or carbonitride formation, the sample subjected to sintering can be subjected to a conventional finish sintering step, i.e. without the effect of the microwave field. This can be accomplished in such manner that the samples are shoved through a furnace chamber which is conventionally heated for the finish sintering. Over some portion of the time period and at some localities a combination of the microwave heating with a conventional heating is possible.

Alternatively thereto it is also possible to provide the metals, the carbon as well as optionally other metals and metal carbides and metal nitrides and/or solid nitrogen compounds as suppliers of carbon and/or nitrogen as are necessary to form the hard phase, such that the composition is subjected at a pressure up to $5\times10^5$ Pa, preferably without pressure, to a reaction sintering in an electrically heated furnace, i.e. without the effect of microwave radiation. Surprisingly, by the use of a reaction sintering process without the application of pressure or with the use of only small pressures, a significantly greater density can be achieved that hitherto have been attainable only with pressuring or a combined sintering with hot isostatic pressing. At least the basic carbides or carbonitrides of the hard metal or cermet base body are present in the starting mixture in the form of purely pulverized metals and graphite and/or carbon black or in the form of pure metals, graphite and/or carbon black and a nitrogen supplier which can be a metal nitride and/or a solid nitrogen compound.

The shaped body can be irradiated continuously or in pulsed fashion with microwaves, at least briefly and/or is heated at a heating rate of 0.1 to $10^4$ C./min.

The prepressed shaped body can contain plastifiers which include optionally nitrogen and which are preferably decomposed during the heating and/or are driven off.

The nitrogen containing plastifier can be a solid, preferably urotropin or aromatic, nitrogen rich heterocycles, like triazine, pyrazole, polypyrazole and salts thereof.

For decomposition and/or driving off the heating rate can be 10° C. to 1° C./min, preferably 5° C. per min.

After the driving off, the heating up rate is $10^{0}$° C./min to $10^{3}$° C./min, preferably 20° C./min to 100° C./min for microwave sintering or 2° C./min to 20° C./min with conventional sintering, until a reaction sintering temperature >1250° C. is achieved.

The reaction sintering temperature can amount to 1250° C. to 1700° C., preferably 1250° C. through 1400° C. with microwave sintering.

The reaction sintering can be carried out in a vacuum, in an inert gas or in a reducing atmosphere. The inert gas atmosphere can be up to volume weight 50% hydrogen or so that the reducing atmosphere consists of hydrogen, methane or mixtures thereof.

The sintering can be carried out under a pressure of at most $2\times10^5$ Pa.

A PVD coating, CVD coating or PCVD coating can be applied in connection with the reaction sintering with the intervening cooling.

The PVC, CVD or PCVD coating can be applied with alteration of the gas composition.

The carbon which is used can be in the form of graphite and/or carbon black and/or in the form of solid mesophase coal or active carbon.

In microwave sintering, the technology known hitherto from DE 43 40 652 can be used with the additional point that not only the sintering but also the carburization or carbonitriding are initiated by microwave fields.

Tests according to the invention have indicated that a complete compaction of the sintered body is found even with reduced reaction sintering times of 5 to 30 min, preferably 10 min. The sintering temperature can also be relatively low and depending upon the grain size of the metal used and the type of carbon source, can be selected from 1250° to 1400° C. In a special application, a hard metal with the following characteristics can be produced:

$H_{v30}$: 2000 to 2500

$K_{Ic}$: 15 to 20 MPa$\sqrt{m}$;

$\sigma_B$: 3500 to 4500 MPa.

The process of the invention is suitable for the hard phase binder compositions within the claims dealing with the composite body, whereby without grain growth but rather with an increase of the grain fineness by selection of suitable grain sizes and compositions of the solid starting materials and by heating by means of microwaves, a reaction to yield a fine grain hard substance in a binder phase is produced, in which simultaneously during the sintering there is a compaction of the hard phase and the binder metal in one process step and as a result the formation of a composite body as a component, like especially a cutting tool, with a density of >99.8% of the theoretical density.

For producing the hard metal green body or cermet green body, preferably waxes can be used as plastifiers, which waxes must be removed prior to sintering at the aforementioned temperatures. The usual waxes used in accordance with the state of the art do not themselves absorb the microwave radiation. By the selective heating of the metal powder and the nonmetallic powder by means of microwave heating and there is a uniform heating of the wax throughout sinter body volume. The sintered body itself is heated by the microwave radiation to higher temperatures than the furnace temperatures, therefore signiticantly simplifying the transport away of the dewaxed product. The dewaxing is carried out with a relatively high heating rate of about 5° C./min. In this process a decomposition-rate-controlled pyrolysis of the wax is possible, especially one which permits material specific heat generation by means of microwave radiation with a finer process control than is obtainable with the convection and thermal conduction customary with the state of the art. The carbon quantity which can be reproducibly introduced during the reaction sintering is used to adjust the phase composition. In the case of the production of cermets, the nitrogen supplier can also be such a plastifier, which itself is nitrogen containing and serves as the nitrogen source for the carbonitride phase to be used. One such nitrogen supplier is, for example, urotropin.

The microwave reaction sintering greatly simplifies the fabrication process and permits it to be carried out in a substantially shorter time. The rate of heating of the charge lies preferably in the range of 10 to 1° C./min and for the dewaxing can range from 10° C./min to $10^{3}$° C./min, preferably 20° C./min to 100° C./min for microwave sintering or 2° C./min to 20° C./min for conventional sintering in the carburization or carbonitriding until a reaction temperature above 1000° C. is reached. Since the microwave reaction sintering is carried out at sample temperatures which lie above that of the furnace walls, it is also possible after shut down of the energy supply to carry out a rapid cooling so that additional grain growth of the cermet or hard metal composite body is countered. Specific to the fabrication process is the use of microwaves for the reaction sintering without any retention time for homogenization of the heating, thereby fulfilling a further condition for avoiding grain growth. For reaction sintering by means of a conventional furnace heating the conditions should correspond to those set out in claims 19ff.

SPECIFIC EXAMPLES

Below the invention is clarified with respect to examples.

For the production of a hard metal with 25% by weight cobalt, balance WC, cobalt, tungsten and carbon, each in powder form, can be mixed together with 1.8 weight % wax as plastifier and prepressed to a green body. The green bodies are uniformly distributed in a furnace and heated with a power density of 0.05 "w/cm$^3$" with microwaves whereby the heating up velocity is between 0.1 to a max of 3° C./per min to about 350° C. In this period the wax is completely burned off. After the burning off of the wax, thus at about a sample temperature of 350° C., the heating rate is increased stepwise, namely initially at 5° C./min to 1000° C. and then at high values until the sintering temperature of about 1250° C. is reached. Then the sintered body is cooled at a rate of 20° C. per min.

The production of cermets is carried out in a corresponding manner with the additional point that, apart from the metals required for the carbonitride phase, the binder metal and the carbon, a nitrogen supplier must be provided. This can be, for example, in the form of a nitride of the metals titanium, zirconium, hafnium, niobium, tantalum and/or molybdenum, whereby these metals themselves react with the carbon to carbonitrides. Alternatively, it is possible to use organic compounds, like urotropin, as nitrogen suppliers which also can simultaneously be plastifiers.

In a concrete example, a mixture of one or more binder metals, like nickel, cobalt and/or iron, optionally with addition of molybdenum in an amount of 3 to 10%, with one or more hard phase formers like, for example, tungsten, molybdenum, titanium, zirconium, hafnium, vanadium, niobium or tantalum, one or more thermally labile nitrides as nitrogen suppliers and the stoichiometric amount of free carbon are mixed to insure complete reaction of the hard phase former and the metal nitride to carbides and carbonitrides. The mixture is pressed and subjected to a microwave field at a temperature between 1200° and 1500° C. By the reaction with the carbon and by metathesis between the nitrides and carbides, the hard phase former produces nitrides, carbides and carbonitrides, for example, in accordance with the following reaction mechanism:

(1) $TiN+Ti+2C \rightarrow TiCN \cdot TiC$ (2) $WN+Ti+2C \rightarrow WC+TiCN$ (3) $MO_2N+Ta+W+2C \rightarrow MO_2C+TaN \cdot WC$ These reaction examples are directed to the formation of TiCN (titanium carbonitride) but are applicable also to other types of cermet compositions. Either the same metal, for example, titanium, can be the nitride supplier as well from the carbide or carbonitride, or the nitride is supplied by a metal which reacts to carbonitride or carbide and a second metal is a hard phase former that produces stabile carbonitrides or nitrides. Examples of thermally labile nitrides which are useable as the carbon sources are: CrN, $Cr_2N$, MoN, $Mo_2N$, $Mo_3N$, WN, $W_2N$, AlN.

Stabile nitrides which can result are the nitrides of titanium, zirconium, hafnium, vanadium, niobium and/or tantalum,. Possible nitrogen donors which can be used in the reaction sintering as plastifiers are aromatic nitrogen rich heterocycles, like triazines, pyrazole, polyprazole and the corresponding metal salts.

The reaction sintering is carried out at standard pressure in the furnace atmosphere.

In a further example for the production of a hard metal with 6% by weight cobalt, balance tungsten carbide, cobalt, tungsten and carbon black (carbon) each in powder form together with 1.8% by weight wax as a plastifier are mixed and prepressed to a green body. The green body or green bodies can be then distributed in a resistance heated furnace and heated with a heating velocity of 100° C./h to 400°. Then, i.e. after the wax has been driven out, the furnace is heated to a sintering temperature of 1400° C. until the desired compaction is obtained. The finish sintered body is cooled at a rate of 10° C./min.

What is claimed is:

1. An oxide free composite body with a binder metal phase and at least one hard phase comprised of:

a cermet material with a binder metal phase of 3 to 30 mass percent, the balance being at least one carbonitride phase or;

a hard metal with at least one hard material phase of 65 to 99 mass percent, the balance being a binder metal phase, wherein the metals of the hard material phase or the carbonitride phase, carbon of the hard material phase or the carbonitride phase, and metal nitrides of the carbonitride phase and solid nitrogen compounds as suppliers of carbon or nitrogen of the hard material phase or the carbonitride phase, are originally exclusively each in powder form and mixed together and compacted to a green body which is then, subjected to reaction sintering under a pressure of $<5\times10^5$ Pa in a microwave field to chemically form the hard phase or the carbonitride phase and in which the hard phase formed forms a liquid phase with the remaining substances which do not participate in the hard phase reaction, the cermet material being in the form of a cermet composite body with at least 70 volume % having a mean grain size <0.4 $\mu$m, the hard metal forming a composite body with at least 70% having a mean grain size <0.5 $\mu$m.

2. The composite body according to claim 1 which is free from V and/or Cr as a grain growth blocker.

3. The composite body according to one of claims 1 wherein at least 70 volume % of the hard metal composite body has a mean grain size <0.4 $\mu$m.

4. The composite body according to claim 1 wherein at least 70 volume % of a cermet composite body has a mean grain size <0.3 $\mu$m.

5. The composite body according to claim 1 wherein the cermet or the hard metal has a hard phase based on Ti, Zr, Hf, Nb, Ta, Mo, and/or W, and a binder metal phase of Co, Ni, and/or Fe.

6. The composite body according to claim 1 wherein the hard metal has hexagonal WC as a first phase and cubic carbide of mixed crystals of W, Ti, Ta and/or Nb as a second phase and a binder metal phase of Co, Ni, Fe or mixtures thereof.

7. The composite body according to claim 1 wherein the hard metal is comprised of the hexagonal mixed carbide WC with MoC and/or cubic mixed carbides of the elements Ti, Zr, Hf, V, Nb, Ta, Cr, Mo, and/or W, with a binder metal phase of Co, Fe, and/or Ni.

8. The composite body according to claim 1 wherein the binder metal phase has up to 15 mass % Mo, W and/or Ti with reference to the total mass of the binder metal phase.

9. The composite body according to claims 1 wherein the binder metal phase has up to 5 mass % Mn and/or Al, with reference to the total mass of the binder metal phase.

10. The composite body according to claim 9 wherein the binder metal phase is comprised of an Al—Ni alloy with an Ni—Al ratio of 90:10 to 70:30.

11. The composite body according to claim 10 wherein the binder metal phase contains up to one mass % boron with reference to the total mass of the binder metal phase.

12. The composite body according to claim 1 wherein the binder metal phase is comprised of $Ni_3Al$, $TiSi_2$, $Ti_2Si_3$, $Ti_3Al$, $Ti_5Si_3$, TiAl, $Ni_2TiAl$, $TiSi_2$, NiSi, $MoSi_2$ or mixtures thereof.

13. The composite body according to claim 12 wherein the binder metal phase contains 0 to 16 mass % of Co, Ni, Fe and/or rare-earth metals.

14. The composite body according to claim 1 wherein the binder metal phase consists essentially of Ni and Cr.

15. The composite body according to claim 14 wherein the binder metal phase further includes Mo, Mn, Al, Si and Cu in amounts of 0.01 to 5 mass %.

16. The composite body according to claim 1 which has at least one layer of said cermet material or hard metal applied in a microwave field by means of PVD, CVD and/or PCVD.

17. A method of producing a composite body comprising:

a cermet material with a binder metal phase of 3 to 30 mass percent, the balance being at least one carbonitride phase or;

a hard metal with at least one hard material phase of 65 to 99 mass percent, the balance being a binder metal phase, wherein the metals of the hard material phase or the carbonitride phase, carbon of the hard material phase or the carbonitride phase, and metal nitrides of the carbonitride phase and solid nitrogen compounds as suppliers of carbon or nitrogen of the hard material phase or the carbonitride phase, are originally exclusively each in powder form and mixed together and compacted to a green body which is then, subjected to reaction sintering under a pressure of $<5\times10^5$ Pa in a microwave field to chemically form the hard phase or the carbonitride phase and in which the hard phase formed forms a liquid phase with the remaining substances which do not participate in the hard phase reaction, the cermet material being in the form of a cermet composite body with at least 70 volume % having a mean grain size <0.4 μm, the hard metal forming a composite body with at least 70% having a mean grain size <0.5 μm, the method comprising forming the hard phase or cermet material by the steps of:

mixing the requisite metals, the carbon metal nitrides and/or solid nitrogen compounds as suppliers for carbon and/or solid nitrogen compounds as suppliers for carbon and nitrogen, exclusively in powder form, preprocessing the resulting powder mixture to a shaped body under a pressure $<5\times10^5$ Pa, and subjecting said body, at least briefly, to a microwave field of 0.01 to 10 $W/cm^3$ to effect a reaction sintering.

18. The method according to claim 17 wherein the shaped body is irradiated continuously or in pulsed fashion with microwaves, at least briefly and/or is heated at a heating rate of 0.1 to $10^{4\circ}$ C./min.

19. The method according to claims 17 wherein the prepressed shaped body contains a plastifier which includes nitrogen, said plastifier being decomposed during heating.

20. The method according to claim 19 wherein the nitrogen-containing plastifier is a solid selected from the group which consists of urotropin, triazine, pyrazole, polypyrazole and salts thereof.

21. The method according to claim 19 wherein for decomposition the heating rate is 10° C. to 1° C./min.

22. The method according to claim 17 wherein a heating up rate of $10^{0\circ}$ C./min to $10^{3\circ}$ C./min is applied for microwave sintering until a reaction sintering temperature >1250° C. is achieved.

23. The method according to claim 17 wherein the reaction sintering temperature amounts to 1250° C. to 1700° C.

24. The method according to claim 17 wherein the reaction sintering is carried out in a vacuum, in an inert gas atmosphere or in a reducing atmosphere.

25. The method according to claim 24 wherein the inert gas atmosphere is up to volume weight 50% hydrogen and the reducing atmosphere consists of hydrogen, methane or mixtures thereof.

26. The method according to claim 24 wherein the sintering is carried out under a pressure of at most $2\times10^5$ Pa.

27. The method according to claim 17 wherein a PVD coating, CVD coating or PCVD coating is applied following the reaction sintering with intervening cooling.

28. The method according to claim 27 wherein the PVC, CVD or PCVD coating is applied with alteration of the gas composition.

29. The method according to claim 17 wherein the carbon is used in the form of graphite and/or carbon black and/or in the form of solid mesophase coal or active carbon.

* * * * *